US006374738B1

(12) United States Patent
Lewis et al.

(10) Patent No.: US 6,374,738 B1
(45) Date of Patent: Apr. 23, 2002

(54) LITHOGRAPHIC IMAGING WITH NON-ABLATIVE WET PRINTING MEMBERS

(75) Inventors: Thomas E. Lewis, East Hampstead, NH (US); Frederick R. Kearney, Walpole, MA (US); Eugene L. Langlais, II, Amherst, NH (US); Steven J. Frank, Framingham, MA (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/564,339

(22) Filed: May 3, 2000

(51) Int. Cl.[7] ..... B41C 1/10; B41N 1/08
(52) U.S. Cl. ..... 101/467; 101/457
(58) Field of Search ..... 101/454, 457, 101/458, 459, 462, 463.1, 465–467; 430/302

(56) References Cited

U.S. PATENT DOCUMENTS

| | | | | | |
|---|---|---|---|---|---|
| 4,292,396 | A | * | 9/1981 | Eime et al. | 101/457 |
| 5,493,971 | A | | 2/1996 | Lewis et al. | 101/454 |
| 5,950,542 | A | * | 9/1999 | Harris et al. | 101/457 |
| 6,085,656 | A | * | 7/2000 | Lewis | 101/467 |
| 6,107,001 | A | * | 8/2000 | Lewis et al. | 101/467 |
| 6,145,565 | A | * | 11/2000 | Fromson et al. | 101/453 |
| 6,168,903 | B1 | * | 1/2001 | Cassidy et al. | 101/467 |
| 6,182,569 | B1 | * | 2/2001 | Rorke et al. | 101/467 |
| 6,182,570 | B1 | | 2/2001 | Rorke et al. | 101/462 |
| 6,186,067 | B1 | * | 2/2001 | Rorke et al. | 101/467 |
| 6,192,798 | B1 | * | 2/2001 | Rorke et al. | 101/467 |

FOREIGN PATENT DOCUMENTS

| | | |
|---|---|---|
| WO | WO99/37481 | 7/1999 |
| WO | WO99/37482 | 7/1999 |

* cited by examiner

*Primary Examiner*—Stephen R. Funk
(74) *Attorney, Agent, or Firm*—Testa, Hurwitz & Thibeault, LLP

(57) ABSTRACT

Lithographic imaging using non-ablative printing members combines the benefits of simple construction, the ability to utilize traditional metal base supports, and amenability to imaging with low-power lasers that need not impart ablation-inducing energy levels. A representative printing member has a topmost layer that is ink-receptive and does not significantly absorb imaging radiation, a second layer thereunder that is hydrophilic and does absorb imaging radiation, and a metal substrate under the second layer. The printing member is selectively exposed to laser radiation in an imagewise pattern, and laser energy passes substantially unabsorbed through the first layer and is absorbed by the second layer. Heat builds up in the second layer sufficiently to detach the first layer, which is formulated to resist reattachment. But the first layer and, more significantly, the third layer act to dissipate heat from the second layer to prevent its ablation. Where the printing member has received laser exposure—that is, where the first and second layers have been detached—remnants of the first layer are readily removed to produce a finished printing plate.

23 Claims, 7 Drawing Sheets

LITHOGRAPHIC IMAGING WITH NON-ABLATIVE WET PRINTING MEMBERS

FIELD OF THE INVENTION

The present invention relates to digital printing apparatus and methods, and more particularly to imaging of lithographic printing-plate constructions on- or off-press using digitally controlled laser output.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

For example, U.S. Pat. No. 5,493,971 discloses wet-plate constructions that extend the benefits of ablative laser imaging technology to traditional metal-based plates. Such plates remain the standard for most of the long-run printing industry due to their durability and ease of manufacture. As shown in FIG. 1, a lithographic printing construction 100 in accordance with the '971 patent includes a grained-metal substrate 102, a protective layer 104 that can also serve as an adhesion-promoting primer, and an ablatable oleophilic surface layer 106. In operation, imagewise pulses from an imaging laser (typically emitting in the near-infrared, or "IR" spectral region) interact with the surface layer 106, causing ablation thereof and, probably, inflicting some damage to the underlying protective layer 104 as well. The imaged plate 100 may then be subjected to a solvent that eliminates the exposed protective layer 104, but which does no damage either to the surface layer 106 or the unexposed protective layer 104 lying thereunder. By using the laser to directly reveal only the protective layer and not the hydrophilic metal layer, the surface structure of the latter is fully preserved; the action of the solvent does no damage to this structure.

A related approach is disclosed in published PCT Application Nos. US99/01321 and US99/01396. A printing member in accordance with this approach, representatively illustrated at 200 in FIG. 2, has a grained metal substrate 202, a hydrophilic layer 204 thereover, an ablatable layer 206, and an oleophilic surface layer 208. Surface layer 208 is transparent to imaging radiation, which is concentrated in layer 206 by virtue of that layer's intrinsic absorption characteristics and also due to layer 204, which provides a thermal barrier that prevents heat loss into substrate 202. As the plate is imaged, ablation debris is confined beneath surface layer 208; and following imaging, those portions of surface layer 208 overlying imaged regions are readily removed. Because layer 204 is hydrophilic and survives the imaging process, it can serve the printing function normally performed by grained aluminum, namely, adsorption of fountain solution.

Both of these constructions rely on removal of the energy-absorbing layer to create an image feature. Exposure to laser radiation may, for example, cause ablation—i.e., catastrophic overheating—of the ablated layer in order to facilitate its removal. Accordingly, the laser pulse must transfer substantial energy to the absorbing layer. This means that even low-power lasers must be capable of very rapid response times, and imaging speeds (i.e., the laser pulse rate) must not be so fast as to preclude the requisite energy delivery by each imaging pulse.

DESCRIPTION OF THE INVENTION

Brief Summary of the Invention

The present invention obviates the need for substantial ablation as an imaging mechanism, combining the benefits of simple construction, the ability to utilize traditional metal base supports, and amenability to imaging with low-power lasers that need not impart ablation-inducing energy levels. In preferred embodiments, the invention utilizes a printing member having a topmost layer that is ink-receptive and does not significantly absorb imaging radiation, a second layer thereunder that is hydrophilic and does absorb imaging radiation, and a substrate under the second layer. The printing member is selectively exposed to laser radiation in an imagewise pattern, and laser energy passes substantially unabsorbed through the first layer into the second layer, where it is absorbed. Heat builds up in the second layer sufficiently to detach the first layer, which is formulated to resist reattachment. But the first layer and, more significantly, the third layer may act to dissipate heat from the second layer to discourage its ablation. Where the printing member has received laser exposure—that is, where the first and second layers have been detached from each other—remnants of the first layer are readily removed by post-imaging cleaning (see, e.g., U.S. Pat. Nos. 5,540,150; 5,870,954; 5,755,158; and 5,148,746) to produce a finished printing plate.

Accordingly, layers that would otherwise undergo complete destruction as a consequence of ablation imaging are retained in the present constructions, and serve as highly durable layers that participate in the printing process. Key to the present invention, then, is irreversible detachment between layers caused by heating, without ablation, of a radiation-absorptive layer.

The plates of the present invention are "positive-working" in the sense that inherently ink-receptive areas receive laser output and are ultimately removed, revealing the hydrophilic layer that will reject ink during printing; in other words, the "image area" is selectively removed to reveal the "background." Such plates are also referred to as "indirect-write."

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention, when taken in conjunction with the accompanying drawings, in which.

Figure 1:
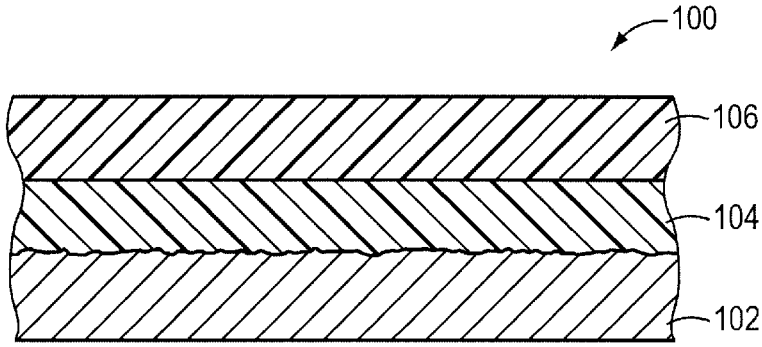
FIG. 1 PRIOR ART
FIGS. 1 and 2 are enlarged sectional views of prior-art printing members.
Figure 2:
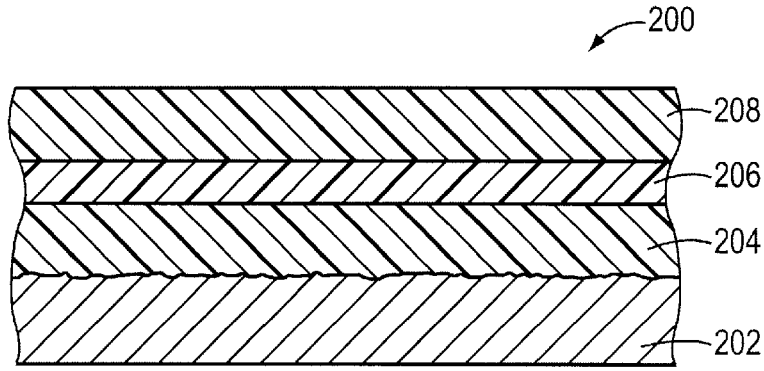
FIG. 2 PRIOR ART

The drawings and elements thereof may not be drawn to scale.

DETAILED DESCRIPTION OF THE PREFERRED EMBODIMENTS

Imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. Nos. Re. 35,512 and 5,385,092 (the entire disclosures of which are hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, in an array-type system it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

Figure 3A:
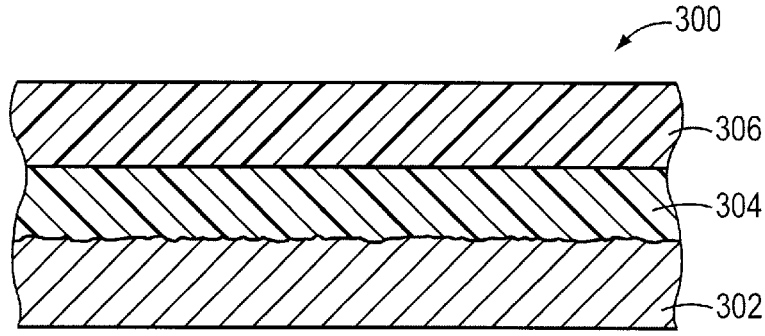
FIGS. 3A and 3B are an enlarged sectional views of positive-working lithographic printing members in accordance with the present invention.
Figure 3B:
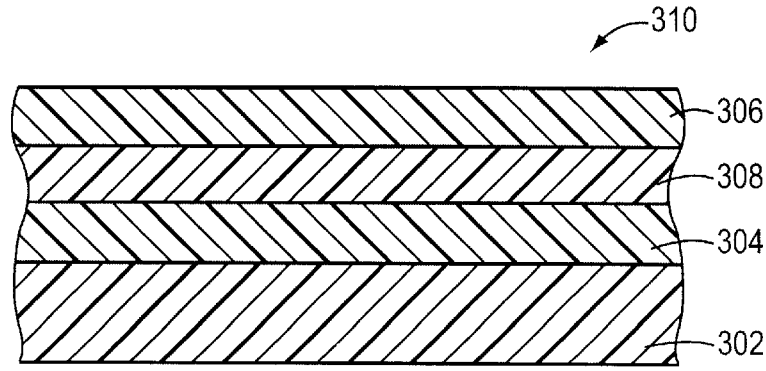

With reference to FIG. 3A, a representative embodiment of a lithographic printing member in accordance herewith is shown at 300, and includes a metal substrate 302, a radiation-absorptive, hydrophilic layer 304, and an oleophilic layer 306 that is substantially transparent to imaging radiation. FIG. 3B illustrates a variation 310 of this embodiment that includes an intermediate layer 308. These layers will now be described in detail.

1. Substrate 302

The primary function of substrate 302 is to provide dimensionally stable mechanical support, and possibly to dissipate heat accumulated in layer 304 to prevent its ablation. Suitable substrate materials include, but are not limited to, alloys of aluminum and steel (which may have another metal such as copper plated over one surface). Preferred thicknesses range from 0.004 to 0.02 inch, with thicknesses in the range 0.005 to 0.012 inch being particularly preferred. Alternatively, if heat conduction is less of an issue (due to relatively low delivered laser energy, high absorber concentration, or a thick layer 304, as described below), substrate 302 may be paper or a polymer (e.g., polyesters such as polyethylene terephthalate and polyethylene naphthalate, or polycarbonates) film as shown in FIG. 3B. Preferred thicknesses for such films range from 0.003 to 0.02 inch, with thicknesses in the range of 0.005 to 0.015 inch being particularly preferred. When using a polyester substrate, it may prove desirable to interpose a primer coating between layers 302 and 304; suitable formulations and application techniques for such coatings are disclosed, for example, in U.S. Pat. No. 5,339,737, the entire disclosure of which is hereby incorporated by reference. It should be understood that either embodiment 300, 310 may be fabricated with a metal, polymer or other substrate 302.

Substrate 302 may, if desired, have a hydrophilic surface. In general, metal layers must undergo special treatment in order to be capable of accepting fountain solution in a printing environment. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." An anodized aluminum substrate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying photopolymer layer. Anodizing and silicate treatment processes are described in U.S. Pat. Nos. 3,181,461 and 3,902,976.

Preferred hydrophilic substrate materials include aluminum that has been mechanically, chemically, and/or electrically grained with or without subsequent anodization. In addition, some metal layers need only be cleaned, or cleaned and anodized, to present a sufficiently hydrophilic surface. A hydrophilic surface is easier to coat with layer 304, and provides better adhesion to that layer. Moreover, such a surface will accept fountain solution if overlying layer 304 is damaged (e.g., by scratching) or wears away during the printing process.

2. Hydrophilic Layer 304

Layer 304 is hydrophilic and absorbs imaging radiation to cause layer 306 to irreversibly detach therefrom. Preferred materials are polymeric and may be based on polyvinyl alcohol. In designing a suitable formulation, cross-linking can be used to control resolubility, filler pigments to modify and/or control rewettability, and pigments and/or dyes to impart absorbence of laser energy. In particular, as fillers, $TiO_2$ pigments, zirconia, silicas and clays are particularly useful in imparting rewettability without resolubility.

Layer 304 may function as the background hydrophilic or water-loving area on the imaged wet lithographic plate. It should adhere well to the support substrate 302 and to the surface layer 306. In general, polymeric materials satisfying these criteria include those having exposed polar moieties such as hydroxyl or carboxyl groups such as, for example, various cellulosics modified to incorporate such groups, and polyvinyl alcohol polymers.

Preferably, layer 304 withstands repeated application of fountain solution during printing without substantial degradation or solubilization. In particular, degradation of layer 304 may take the form of swelling of the layer and/or loss of adhesion to adjacent layers. This swelling and/or loss of adhesion may deteriorate the printing quality and dramatically shorten the press life of the lithographic plate. One test of withstanding the repeated application of fountain solution during printing is a wet rub resistance test. Satisfactory results in withstanding the repeated application of fountain solution and not being excessively soluble in water or in a cleaning solution, as defined herein for the present invention, are the retention of the 3% dots in the wet rub resistance test.

To provide insolubility to water, for example, polymeric reaction products of polyvinyl alcohol and crosslinking agents such as glyoxal, zinc carbonate, and the like are well-known in the art. For example, the polymeric reaction products of polyvinyl alcohol and hydrolyzed tetramethylorthosilicate or tetraethylorthosilicate are described in U.S. Pat. No. 3,971,660. It is preferred, however, that the crosslinking agent have a high affinity for water after drying and curing the hydrophilic resin. Suitable polyvinyl alcohol-based coatings for use in the present invention include, but are not limited to, combinations of AIRVOL 125 polyvinyl alcohol; BACOTE 20, an ammonium zirconyl carbonate solution available from Magnesium Elektron, Flemington, N.J.; glycerol; pentaerythritol; glycols such as ethylene glycol, diethylene glycol, trimethylene diglycol, and propylene glycol; citric acid, glycerophosphoric acid; sorbitol; gluconic acid; and TRITON X-100, a surfactant available from Rohm & Haas, Philadelphia, Pa. Typical amounts of BACOTE 20 utilized in crosslinking polymers are less than 5 wt % of the weight of the polymers, as described, for example, in "The Use of Zirconium in Surface Coatings," Application Information Sheet 117 (Provisional), by P. J. Moles, Magnesium Electron, Inc., Flemington, N.J. Surprisingly, it has been found that significantly increased levels of BACOTE 20, such as 40 wt % of the polyvinyl alcohol polymer, provide significant improvements in the ease of cleaning the laser-exposed areas, in the durability and adhesion of the ink-accepting areas of the plate during long press runs, and in the fine image resolution and printing quality that can be achieved. These results show that zirconium compounds, such as, for example, BACOTE 20, have a high affinity for water when dried and cured at high loadings in a crosslinked coating containing polyvinyl alcohol. The high levels of BACOTE 20 also provide a layer 304 that interacts with a subsequent coating application of the surface layer (or a primer layer) to further increase the insolubility and resistance to damage from laser radiation and from contact with water, a cleaning solution, or a fountain solution. In one embodiment, layer 304 comprises ammonium zirconyl carbonate in an amount greater than 10 wt % based on the total weight of the polymers present in the hydrophilic third layer. Zirconyl carbonate may, for example, be present in an amount of 20 to 50 wt % based on the total weight of polymers present in layer 304.

Other suitable coatings include copolymers of polyvinyl alcohol with polyvinyl pyrrolidone (PVP), and copolymers of polyvinylether (PVE), including polyvinylether/maleic anhydride versions.

Layer 304 may comprise a hydrophilic polymer and a crosslinking agent. Suitable hydrophilic polymers for layer 304 include, but are not limited to, polyvinyl alcohol and cellulosics. In a preferred embodiment, the hydrophilic polymer is polyvinyl alcohol. In one embodiment, the crosslinking agent is a zirconium compound, preferably ammonium zirconyl carbonate. In one embodiment, the layer 304 is characterized by being not soluble in water or in a cleaning solution. In another embodiment, layer 304 is characterized by being slightly soluble in water or in a cleaning solution.

Layer 304 is coated in this invention typically at a thickness in the range of from about 1 to about 40 $\mu$m and more preferably in the range of from about 2 to about 25 $\mu$m. After coating, the layer is dried and subsequently cured at a temperature between 135° C. and 185° C. for between 10 sec and 3 min and more preferably at a temperature between 145° C. and 165° C. for between 30 sec and 2 min.

In the case of IR or near-IR imaging radiation, suitable absorbers include a wide range of dyes and pigments, such as carbon black, nigrosine-based dyes, phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, WI); naphthalocyanines (see, e.g., U.S. Pat. Nos. 4,977,068; 4,997,744; 5,023,167; 5,047,312; 5,087,390; 5,064,951; 5,053,323; 4,723,525; 4,622,179; 4,492,750; and 4,622,179); iron chelates (see, e.g., U.S. Pat. Nos. 4,912,083; 4,892,584; and 5,036,040); nickel chelates (see, e.g., U.S. Pat. Nos. 5,024,923; 4,921;317; and 4,913,846); oxoindolizines (see, e.g., U.S. Pat. No. 4,446,223); iminium salts (see, e.g., U.S. Pat. No. 5,108,873); and indophenols (see, e.g., U.S. Pat. No. 4,923,638). Any of these materials may be dispersed in a prepolymer before cross-linking into a final film.

The absorption sensitizer should minimally affect adhesion between layer 304 and the layers above and below. Surface-modified carbon-black pigments sold under the trade designation CAB-O-JET 200 by Cabot Corporation, Bedford, Mass. are found to minimally disrupt adhesion at loading levels providing adequate sensitivity for heating. The CAB-O-JET series of carbon black products are unique aqueous pigment dispersions made with novel surface modification technology, as, for example, described in U.S. Pat. Nos. 5,554,739 and 5,713,988. Pigment stability is achieved through ionic stabilization. No surfactants, dispersion aids, or polymers are typically present in the dispersion of the CAB-O-JET materials. CAB-O-JET 200 is a black liquid, having a viscosity of less than about 10 cP (Shell #2 efflux cup); a pH of about 7; 20% (based on pigment) solids in water; a stability (i.e., no change in any physical property) of more than 3 freeze-thaw cycles at −20° C., greater than six weeks at 70° C., and more than 2 yr at room temperature; and a mean particle size of 0.12 $\mu$m, with 100% of the particles being less than 0.5 $\mu$m. Significantly, CAB-O-JET 200 also absorbs across the entire infrared spectrum, as well as across the visible and ultraviolet regions.

BONJET BLACK CW-1, a surface-modified carbon-black aqueous dispersion available from Orient Corporation, Springfield, N.J., also resulted in adhesion to the hydrophilic layer 304 at the amounts required to give adequate sensitivity for ablation.

Other near-IR absorbers for absorbing layers based on polyvinyl alcohol include conductive polymers, e.g., polyanilines, polypyrroles, poly-3,4-ethylenedioxypyrroles, polythiophenes, and poly-3,4-ethylenedioxythiophenes. As polymers, these are incorporated into layer 304 in the form of dispersions, emulsions, colloids, etc. due to their limited solubility. Alternatively, they can be formed in situ from monomeric components included in layer 304 as cast (on substrate 302) or applied to layer 304 subsequent to the curing process—i.e., by a post-impregnation (or saturation) process; see, e.g., U.S. Pat. No. 5,908,705. For conductive polymers based on polypyrroles, the catalyst for polymerization conveniently provides the "dopant" that establishes conductivity.

Certain inorganic absorbers, dispersed within the polymer matrix, also serve particularly well in connection with absorbing layers based on polyvinyl alcohol. These include TiON, TiCN, tungsten oxides of chemical formula $WO_{3-x}$, where $0<x<0.5$ (with $2.7\leqq x\leqq 2.9$ being preferred) ; and vanadium oxides of chemical formula $V_2O_{5-x}$, where $0<x<1.0$ (with $V_6O_{13}$ being preferred).

Suitable coatings may be formed by known mixing and coating methods, for example, wherein a base coating mix is formed by first mixing all the components, such as water; 2-butoxyethanol; AIRVOL 125 polyvinyl alcohol; UCAR WBV-110 vinyl copolymer; CYMEL 303 hexanethoxymethylmelamine crosslinking agent; and CAB-O-JET 200 carbon black (not including any crosslinking catalyst). To extend the stability of the coating formulation, any crosslinking agent, such as NACURE 2530, is subsequently added to the base coating mix or dispersion just prior to the coating application. The coating mix or dispersion may be applied by any of the known methods of coating application, such as, for example, wire-wound rod coating, reverse-roll coating, gravure coating, or slot-die coating. After drying to remove the volatile liquids, a solid coating layer is formed.

Working examples for layer 304 are set forth below in the discussion of imaging techniques.

3. Surface Layer 306

Layer 306 accepts ink and is substantially transparent to imaging radiation. By "substantially transparent" is meant that the layer does not significantly absorb in the relevant spectral region, i.e., passes at least 90% of incident imaging radiation. Important characteristics of ink-accepting surface layer 306 include oleophilicity and hydrophobicity, resistance to solubilization by water and solvents, and durability when used on a printing press. Suitable polymers utilized in this layer should have excellent adhesion to layer 304 or 308, and high wear resistance. They can be either water-based or solvent-based polymers. Any decomposition byproducts produced by ink-accepting surface layer 306 should be environmentally and toxicologically innocuous. This layer also may include a crosslinking agent which provides improved bonding to layer 304 and increased durability of the plate for extremely long print runs.

Beyond these general requirements, the criteria dictating suitable materials for layer 306 stem from the mode of imaging contemplated hereby. When an imaging pulse reaches plate 300, it passes through layer 306 and heats layer 304, causing thermal degradation of the bond between these layers. Moreover, layer 306 desirably releases gas upon heating, forming a pocket that ensures complete detachment in the region of exposure, and is capable of stretching as the pocket expands. In any case, surface layer 306 is formulated to resist reattachment to layer 304 following the imaging pulse.

In one version, layer 306 is chemically formulated to undergo thermal homolysis (pyrolysis) in response to the heat applied to the underside of layer 306 by energy-absorbing layer 304. For example, layer 306 may be (or include as a primary polymer component) a silicone block copolymer having a chemically labile species as one of the blocks. This type of material is easily thermally degraded, undergoing chemical transformations that discourage re-adhesion to underlying layer 304.

In an exemplary approach, the silicone block copolymer has an ABA structure, where the A blocks are functionally terminated polysiloxane chains and the B block is a different polymeric species. A suitable chemical formula is shown in FIG. 4C, in which T denotes a terminal group (typically —$OSi(CH_3)_3$ or —$Osi(CH_3)_2H$); $R_1$–$R_4$ are alkyl or aryl substituents, such as the oleophilicity-conferring groups discussed below; m and n typically range from 5 to 10 (but can be larger, if desired); and "Polymer" can denote additional siloxane groups without reactive functional moieties, an acrylic (particularly versions with high polymethylmethacrylate content), an epoxy, a polycarbonate, a polyester, a polyimide, a polyurethane, a vinyl (particularly copolymers based on vinyl acetate or vinyl ether), or an "energetic polymer." The latter are polymeric species containing functional groups that exothermically decompose to generate gases under pressure when rapidly heated (generally on a time scale ranging from nanoseconds to milliseconds) above a threshold temperature. Such polymers may contain, for example, azido, nitrato, and/or nitramino functional groups. Examples of energetic polymers include poly[bis(azidomethyl)]oxetane (BAMO), glycidyl azide polymer (GAP), azidomethyl methyloxetane (AMMO), polyvinyl nitrate (PVN), nitrocellulose, acrylics, and polycarbonates. As illustrated in the figure, the methylhydrogensiloxane groups can bond to exposed hydroxyl groups in a BACOTE-crosslinked polyvinyl alcohol layer 304.

Figure 4A:
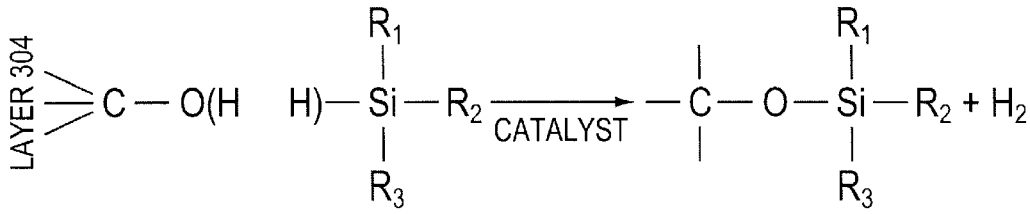
FIGS. 4A–4G illustrate silicone reactions useful in accordance with some embodiments of the invention.
Figure 4B:
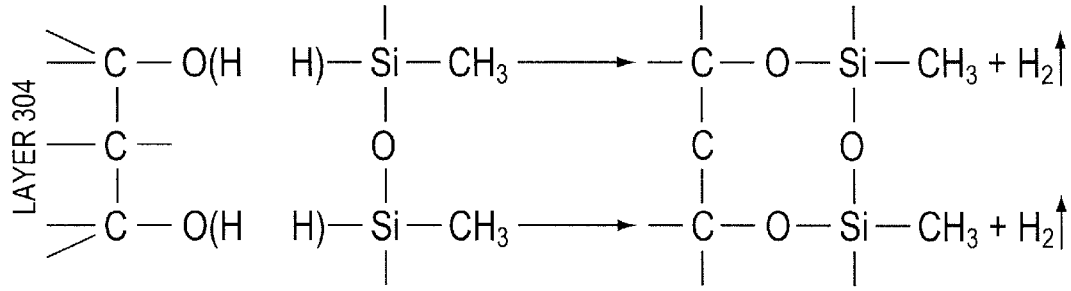
Figure 4C:
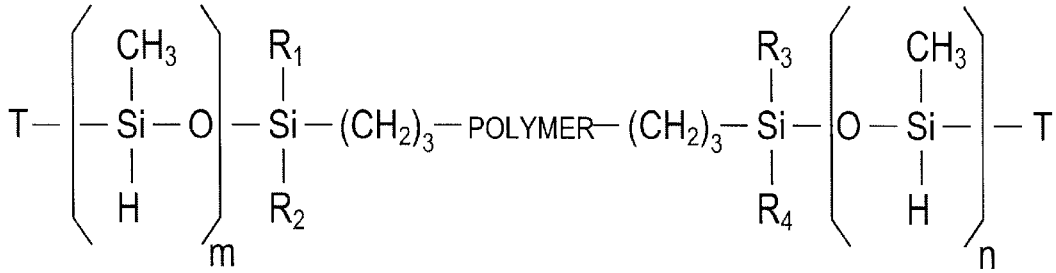
Figure 4D:
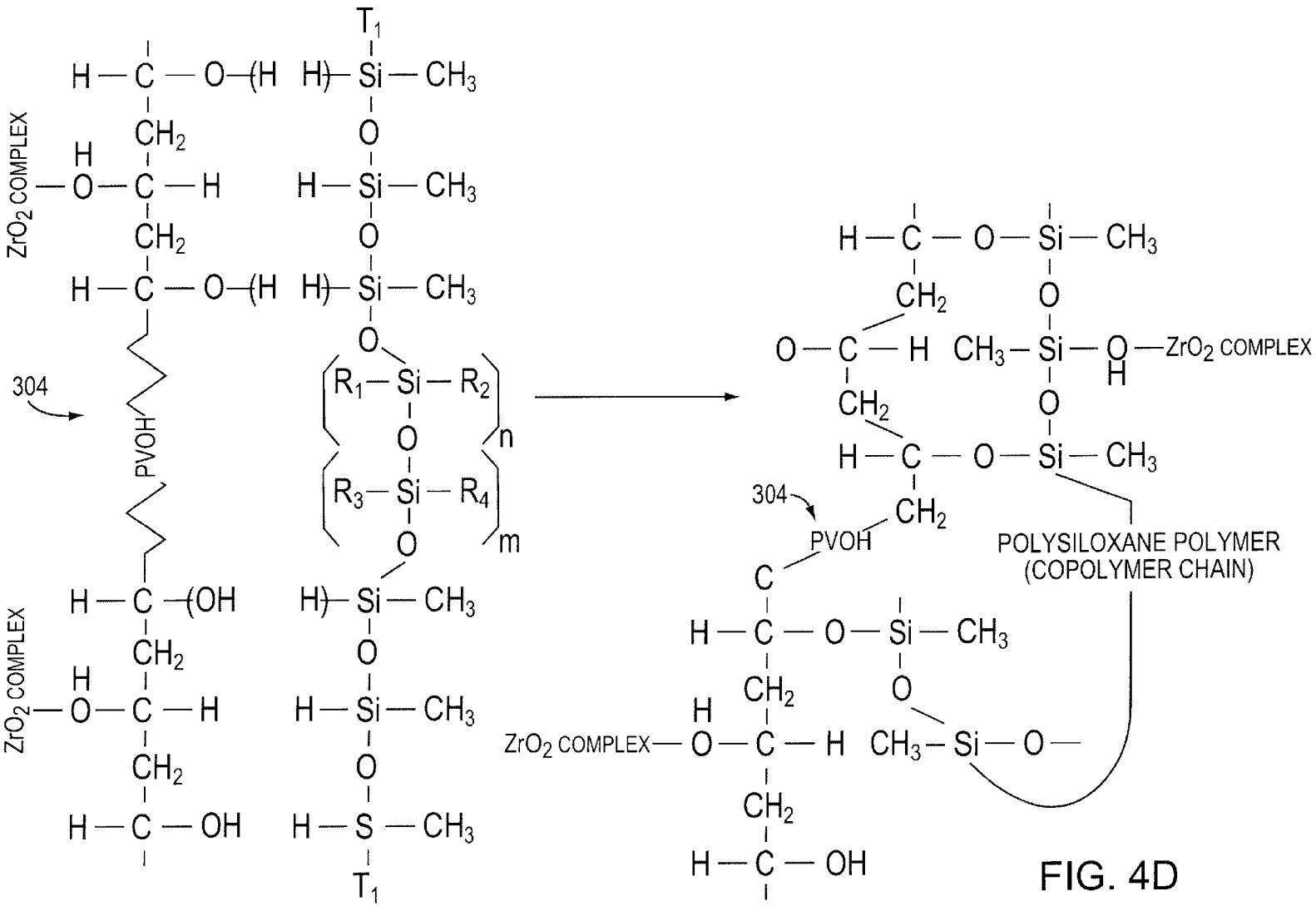
Figure 4E:
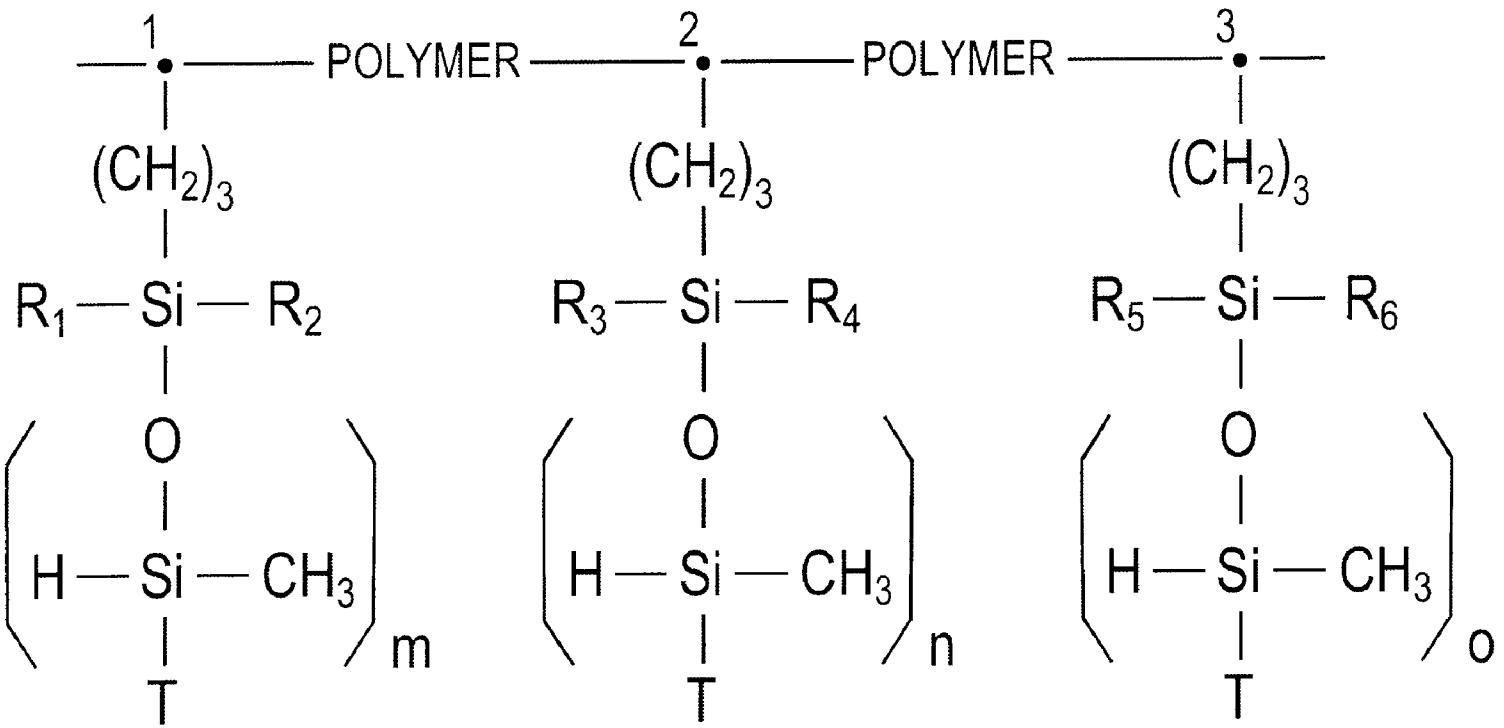

Alternatively, as shown in FIG. 4E, the siloxane (A) blocks can be pendant from a long polymer chain at various branch points (numbered in the figure) distributed along its length; once again m, n, and in this case o are as described above.

Other suitable polymers include, but are not limited to, polyurethanes, cellulosic polymers such as nitrocellulose, polycyanoacrylates, and epoxy polymers. For example, polyurethane-based materials are typically extremely tough and may have thermosetting or self-curing capability. An exemplary coating layer may be prepared by mixing and coating methods known in the art, for example, wherein a mixture of polyurethane polymer and hexamethoxymethylmelamine crosslinking agent in a suitable solvent, water, or solvent-water blend is combined, followed by the addition of a suitable amine-blocked p-toluenesulfonic acid catalyst to form the finished coating mix. The coating mix is then applied to layer 304 using one of the conventional methods of coating application, and subsequently dried to remove the volatile liquids and to form a coating layer. Polymeric systems containing components in addition to polyurethane polymers may also be combined to form the ink-accepting surface layer 306. For example, an epoxy polymer may be added to a polyurethane polymer in the presence of a crosslinking agent and a catalyst.

Ink-accepting surface layer 306 is typically coated at a thickness in the range of from about 0.1 to about 20 $\mu$m and more preferably in the range of from about 0.1 to about 2 $\mu$m. After coating, the layer is dried and preferably cured at a temperature of between 145° C. and 165° C.

It is also found that compounds formed by reaction of hydride-functional silanes and silicones provide suitable materials for layer 306. Although silicones are commonly employed to reject ink in dry-plate constructions, they can also be formulated to accept ink as set forth herein. The term "silane" refers to $SiH_4$ or a compound in which another atom or moiety replaces one or more hydrogen atoms; polysilanes are compounds in which silicon atoms are directly linked. The term "siloxane" refers to the —($R_2$Si—O )— unit, where R is hydrogen or a substituent, and is always used in the context of multiple-unit linkages; silicones are polydiorganosiloxanes, i.e., siloxane chains in which the R groups are organic (or hydrogen). Hydride-functional silanes and siloxanes bear hydrogen as a reactive functional group, and will react, for example, with silanols in the presence of an appropriate metal salt catalyst. Accordingly, hydride-functional silanes and silicones applied to a hydrophilic layer 304 bearing surface hydroxyl groups can readily react with the exposed groups and establish strong covalent bonds between the layers.

Two basic methods of application can be utilized. Relatively low molecular weight silane monomers can be used in vapor-phase approaches, as detailed, for example, in U.S. Pat. Nos. 5,440,446; 4,954,371; 4,696,719; 4,490,774; 4,647,818; 4,842,893; and 5,032,461, the entire disclosures of which is hereby incorporated by reference. In accordance therewith, a monomer is applied as a vapor under vacuum. For example, the monomer may be flash evaporated and injected into a vacuum chamber, where it condenses onto the surface. A related approach is described in U.S. Pat. No. 5,260,095, the entire disclosure of which is also incorporated by reference. In accordance with this patent, a monomer may be spread or coated onto a surface under vacuum, rather than condensed from a vapor.

Higher molecular weight silanes and polymers can be applied as fluids (typically as solvent solutions) using conventional coating techniques; see, e.g., the '512 and '092 patents.

A first class of reaction, illustrated in FIG. 4A, utilizes a hydrogen-functional silane monomer to react with surface-bound hydroxyl groups in layer 304 by dehydrogenation. The moieties $R_1$, $R_2$, $R_3$ may be hydrogen or an organic substituent, so long as at least one of the R moieties is not hydrogen, and are desirably chosen to impart oleophilic properties. In particular, the R moieties can be organic groups confer oleophilicity; appropriate groups can be aliphatic, aromatic, or mixed species, and include alkyl groups ranging from —$C_2H_5$ to —$C_{18}H_{37}$, cycloalkyl groups, polycycloalkyl groups, phenyl, and substituted phenyl groups. The silane monomer may, for example, be applied in the vapor phase and bound directly to the surface of layer 304.

It is also possible to use siloxane polymers or prepolymers with adjacent hydride-functional silicon atoms. As shown in FIG. 4B, these will react with similarly spaced surface hydroxyl sites on layer 304. The methyl groups of the illustrated polymethylhydrosiloxane chain may be replaced with other organic groups (preferably conferring oleophilicity, as described above in connection with FIG. 4A) to promote or enhance ink acceptance. Moreover, incomplete reaction between hydrosiloxane functional groups and surface hydroxyl groups leaves the former available for subsequent reaction with another species, as discussed above.

As illustrated in FIG. 4D, it is preferred to distribute the SiH-functional moieties in blocks along the polymer chain, rather than by random scattering. This facilitates faster reaction and more effective bonding. The ABA block copolymer approach shown in FIG. 4D places blocks of reactive SiH-functional moieties at the ends of the polymer, with the middle (B block) of the polymer being substantially nonreactive (and, once again, preferably conferring oleophilicity). The result is a pair of reactive blocks separated by a large polymer chain 420 of the form $[—R_1R_2SiO—]_n[—R_3R_4SiO—]_m$ (where the R groups may be the same or different and may also be varied along the chain, and in any case are preferably oleophilicity-conferring groups as discussed above). The result is that potentially large unbound loops (representing the intervening siloxane polymer or copolymer chain) containing oleophilic groups project from the surface of layer 304.

Figure 4F:
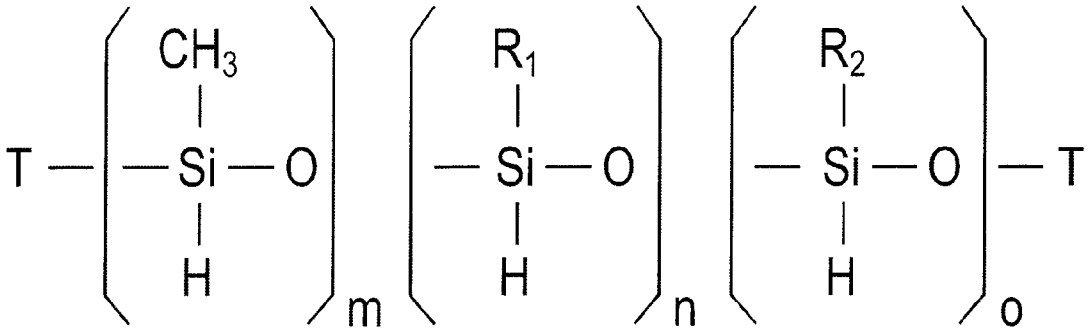
Figure 4G:
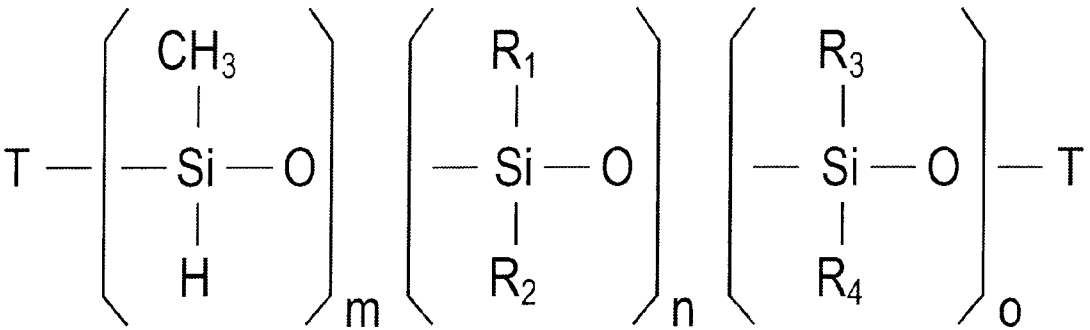

The block approach is not mandatory, however, as illustrated in FIGS. 4F and 4G. FIG. 4F shows the use of a polyorganohydrosiloxane chain, in which each siloxane group contains a reactive hydrogen atom. The $R_1$ and $R_2$ groups preferably confer oleophilicity, and if of large size may also sterically hinder reaction with the effect of desirably slowing the kinetics. FIG. 4G shows alternatives to the ABA block form; reactive SiH and other reactive or unreactive groups may be spread in blocks (e.g., m, n, o≧10) throughout the polymer chain to concentrate reactivity and oleophilicity as desired. Control of block formation, size and abundance is determined by the quantities of the individual monomers used and when, or in what sequence, they are added to the reaction mixture during polymerization. A monomer may, for example, be added several times to the mixture or only at the beginning.

The following is a working formulation for a silane-based layer 306:

| Component (parts by weight) | Example 1 |
|---|---|
| PS-120 | 10.0 |
| Heptane | 189.8 |
| PC-072 | 0.2 |

The following is another working formulation for layer 306:

| Component (parts by weight) | Example 2 |
|---|---|
| WITCOBOND W-240 | 23.5 |
| CYMEL 303 | 2.5 |
| TRITON X-100 | 2.0 |
| 2-butoxyethanol | 2.0 |
| Water | 165.0 |
| NACURE 2530 | 5.0 |

Finally, the following examples represent nitrocellulose-based coatings suitable for layer 306:

EXAMPLE 3

A nitrocellulose-based coating was prepared as described in Example 1 of U.S. Pat. No. 5,493,971 and was coated with a #8 wire wound rod upon a cured hydrophilic polyvinyl alcohol-based coated, grained, anodized, and silicated aluminum substrate and cured for 120 sec at 145° C. A second similar cured hydrophilic polyvinyl alcohol-based coated, grained, anodized and silicated substrate was coated with NACURE 2530 (25% PTSA) using a smooth rod and dried only.

This primed surface was then coated with the nitrocellulose-based coating from U.S. Pat. No. 5,493,971 (Example 1) using a #8 wire wound rod and cured for 120 sec at 145° C. The primed construction exhibits better interlayer adhesion and better durability in printing.

EXAMPLE 4

A nitrocellulose-based coating was prepared as described in Example 1 of U.S. Pat. No. 5,493,971 and was coated with a #8 wire wound rod upon a cured hydrophilic polyvinyl alcohol-based coated, grained, anodized, and silicated aluminum substrate and cured for 120 sec at 145° C. A second similar cured hydrophilic polyvinyl alcohol-based coated, grained, anodized and silicated substrate was coated with a 0.875% solids coating of BACOTE 20 using a #3 wire wound rod and dried only. This primed surface was then coated with the nitrocellulose-based coating from U.S. Pat. No. 5,493,971 (Example 1) using a #8 wire wound rod and cured for 120 sec at 145° C. The primed construction exhibits better interlayer adhesion and better durability in printing.

4. Intermediate Layer 308

The role of intermediate layer 308 is to facilitate cleaning through exposure to fountain solution or water notwithstanding the use of an especially durable surface layer 306. In other words, owing to the water-responsiveness of layer 308, a more tenaciously adhered surface layer 306 can be employed without compromising the ability to clean conveniently following imaging. Once again, it is desirable that any imaging byproducts produced by layer 308 be environmentally and toxicologically innocuous.

Adhesion to underlying layer 304 is dependent in part upon the chemical structure and the bonding sites available on the polymers in layer 308. It is important that the bonding be strong enough to provide adequate adhesion to underlying layer 304, but should also be relatively easily weakened during the imaging process to ease cleaning. For example, vinyl-type polymers, such as polyvinyl alcohol, strike an appropriate balance between these two properties. For example, significantly improved adhesion to layer 304 as well as easy cleaning after imaging is provided by use of AIRVOL 125 polyvinyl alcohol incorporated into layer 308. Crosslinking agents may also be added.

Functional groups (such as hydrogen, vinyl, amine, or hydroxyl) in the polymer of layer 308 may be chosen for reaction with a complementary functional group integrated within layer 306 and/or 304. For example, the polymer of layer 308 may contain free amine or hydroxyl groups capable of crosslinking to a subsequently applied epoxy-functional polymer or prepolymer representing layer 306; epoxy-functional materials are oleophilic and known for their toughness and durability. An amine or hydroxyl group may also react with a subsequently applied isocyanate (—NCO) functional species to form urea or urethane linkages, respectively, and unreacted isocyanate groups themselves crosslinked into a polyurethane by subsequent application of a polyol crosslinker; polyurethanes are also oleophilic and known for flexibility, toughness, and durability.

More generally, layer 308 comprises one or more polymers, and may also comprise a crosslinking agent. Suitable polymers include, but are not limited to, cellulosic polymers such as nitrocellulose; polycyanocrylates; polyurethanes; polyvinyl alcohols; and other vinyl polymers such as polyvinyl acetates, polyvinyl chlorides, and copolymers and terpolymers thereof. In one embodiment, one or more polymers is a hydrophilic polymer. The crosslinking agent, if employed, may be a melamine.

It is possible to employ an organic sulfonic acid catalyst at levels higher than those typically used for catalyst purposes, such as, for example, 0.01 to 12 wt % based on the total weight of polymers present in the coating layer for conventional crosslinked coatings.

For example, in U.S. Pat. No. 5,493,971, NACURE 2530 is present in Examples 1 to 8 as a catalyst for the thermoset cure of an ablative-absorbing surface layer. By assuming that the NACURE 2530 used in these examples in the '971 patent contained the same 25 wt % of p-toluenesulfonic acid as reported by the manufacturer for the lots of NACURE 2530 used in the examples of the present invention, calculation of the weight percentage of the p-toluenesulfonic acid component in the ablative-absorbing surface layer of the '971 patent may be performed by multiplying the weight of NACURE 2530 (4 parts by weight) by 0.25 to give 1.0 parts by weight and then dividing the 1.0 parts by weight by the combined dry weight of the polymers present (13.8 parts by weight in Examples 1 to 7 and 14.0 parts by weight in Example 8) to give 7.2 wt % (Examples 1 to 7 of the '971 patent) and 7.1 wt % (Example 8 of the '971 patent).

High levels of NACURE 2530 added to the nitrocellulose solvent mix provide some improvements in adhesion although the improvement is not nearly as great as that found in water-based coatings containing polyvinyl alcohol polymers and high levels of NACURE 2530.

In one embodiment, layer 308 comprises greater than 13 wt % of an organic sulfonic acid component based on the total weight of polymers present in layer 308. The organic sulfonic acid component may be an aromatic sulfonic acid such as p-toluenesulfonic acid (e.g., present as a component of the amine-blocked p-toluenesulfonic acid, NACURE 2530). The organic sulfonic acid component may be present in an amount of 15 to 75 wt % of the total weight of polymers present in layer 308. In a preferred embodiment, the organic sulfonic acid component is present in an amount of 20 to 45 wt % of the total weight of polymers present in layer 308.

The following are additional working formulations for layer 308:

| Component (parts by weight) | Example 5 | Example 6 |
|---|---|---|
| AIRVOL 125 | 8.0 | 4.0 |
| UCAR WBV-110 | — | 8.5 |
| CYMEL 303 | 1.5 | 1.5 |
| TRITON X-100 | 0.5 | 0.5 |
| 2-butoxyethanol | 7.0 | 7.0 |
| Water | 174.0 | 171.5 |
| NACURE 2530 | 20.0 | 20.0 |

Layer 308 is typically coated at a thickness in the range of from about 0.1 to about 20 $\mu$m and more preferably in the range of from about 0.1 to about 0.5 $\mu$m. After coating, the layer is dried and subsequently cured at a temperature between 135° C. and 250° C. for between 10 sec and 3 min. The optimal cure time/temperature combination is determined by the characteristics of layer 308 and, more significantly, the thickness and material of the much thicker substrate 302. A metal substrate, for example, will act as a heat sink, requiring more vigorous and/or sustained heating to cure layer 308.

5. Imaging Techniques

Figure 5A:
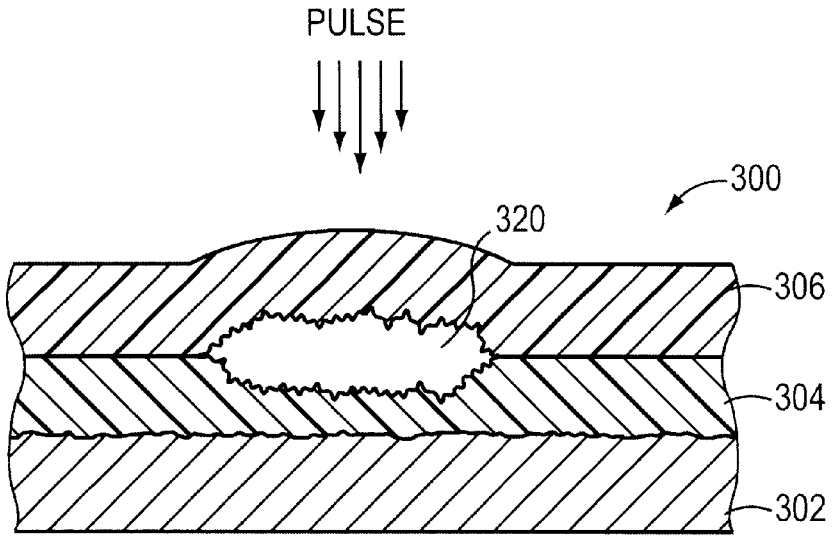
FIGS. 5A–5C illustrate the imaging mechanism of the present invention.
Figure 5B:
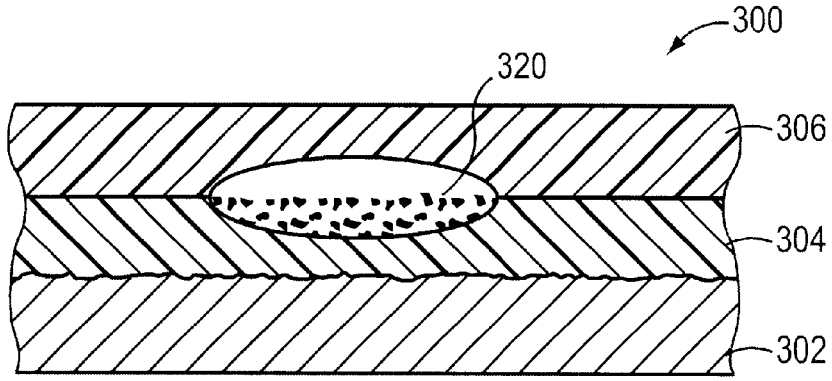
Figure 5C:
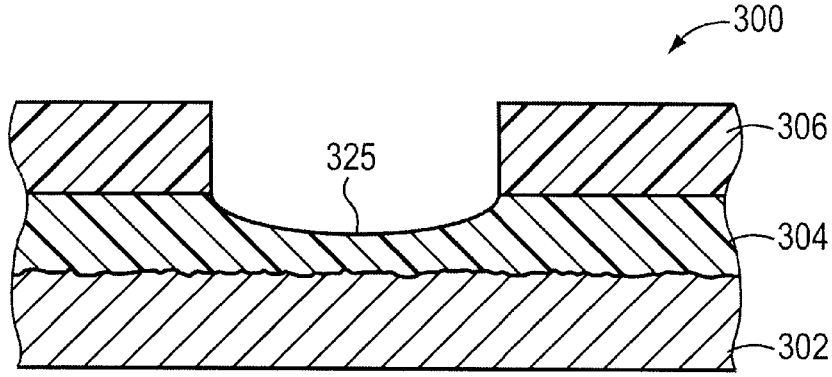

FIGS. 5A–5C illustrate the consequences of exposing the printing member 300 to the output of an imaging laser. When an imaging pulse (having a Gaussian spatial profile as indicated) reaches printing member 300, it passes through layer 306 and heats layer 304, possibly (but not necessarily) causing formation of a gas bubble or pocket 320. If formed, expansion of pocket 320 lifts layer 306 off layer 304 in the region of the imaging pulse. Surface layer 306 is formulated to resist reattachment to layer 304. Consequently, as shown in FIG. 5B, following separation layers 304, 306 remain separated, and some imaging debris—representing damage to the previously bonded surfaces of layers 304, 306—accumulates in the pocket 320. Post-imaging cleaning of printing member 300 results in removal of layer 306 where detached by laser pulses, exposing the surface 325 of layer 304 (FIG. 5C). Surface 325 may "dip" somewhat—i.e., layer 304 may not be as thick where imaged as where it is intact—but does not undergo substantial ablation. (By "substantial ablation" is meant destruction of enough of the thickness of layer 304—generally in excess of 75%—as to compromise its durability during commercial print runs. Accordingly, a layer 304 that does not undergo substantial ablation loses less than 50% of its thickness as a consequence of imaging and thereby retains adequate durability.)

Unlike ablation systems, in which the heating layer is destroyed by imaging radiation, the present invention requires the heat accumulating in that layer to merely cause detachment of the overlying layer. The heated layer persists following imaging and participates in the printing process.

In considering present approach against ablation-type systems, it should be recognized that heating a multi-layer recording construction having a heat-sensitive layer can produce any of five results: (1) if insufficient heating energy is applied, the heated layer will be unaffected; (2) if the layers of the recording material are not well-chosen, the heated layer may become hot, but may not cause detachment of the overlying layer; (3) if the layers of the recording material are not well-chosen, the heated layer may cause the overlying layer to detach, but it will then reattach; (4) if the layers of the recording material are properly chosen, the overlying layer may be detached from the heated layer and remain detached; or (5) if a substantial quantity of energy is applied, the heat-sensitive layer may be ablated.

The present invention concerns only the fourth possibility. Accordingly, the proper amount of energy must be delivered to cause the desired behavior. This, in turn, is a function of parameters such as laser power, the duration of the pulse, the intrinsic absorption of the heat-sensitive layer (as determined, for example, by the concentration of absorber therein), the thickness of the heat-sensitive layer, and the presence of a thermally conductive layer beneath the heat-sensitive layer. These parameters are readily determined by the skilled practitioner without undue experimentation. It is possible, for example, to cause the same materials to undergo ablation or to simply become heated without damage.

Figure 6A:
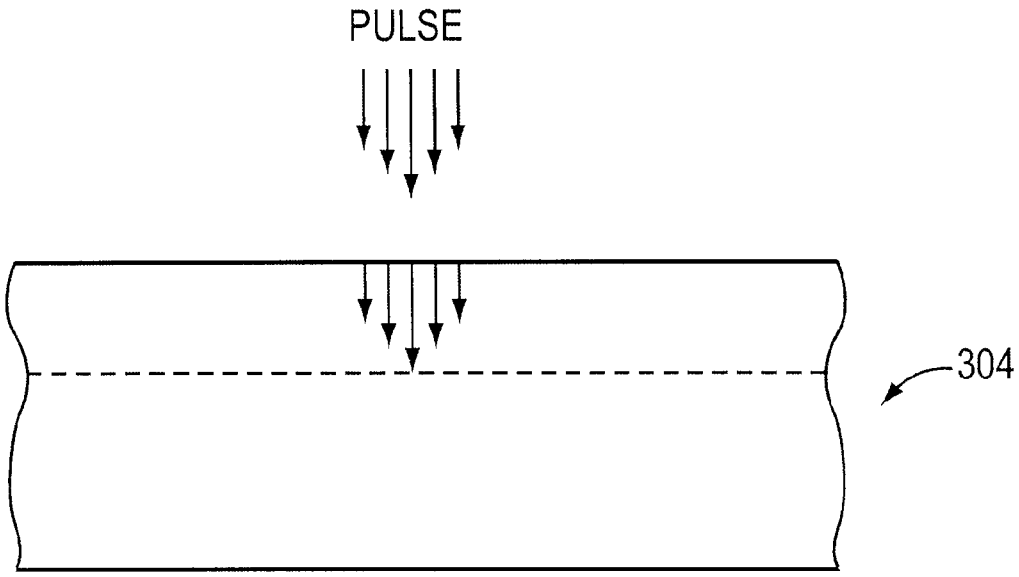
FIGS. 6A and 6B illustrate the effects of absorptive-layer thickness on total energy absorption.
Figure 6B:
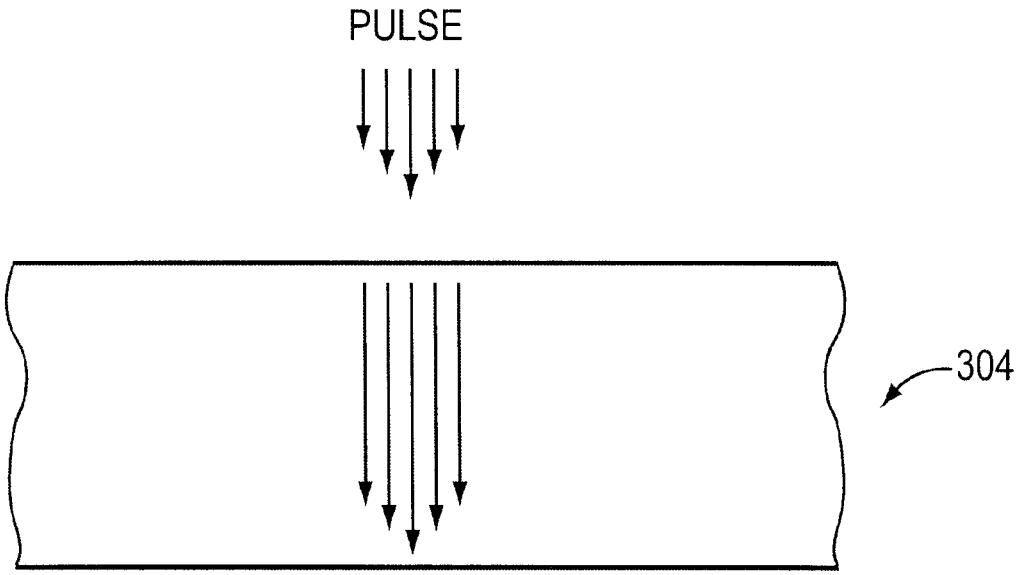

The effect of absorber loading level is illustrated in FIGS. 6A and 6B. In FIG. 6A, the layer 304 has a high loading level of absorber. As a result, the energy delivered by a laser pulse is fully absorbed near the top of the layer; it does not penetrate substantially into the layer thickness. Any damage caused by the laser energy will therefore be confined to the top portion of the layer, which will not undergo substantial ablation. FIG. 6B illustrates the consequence of a lower absorber concentration. In this case, the energy of the laser pulse can penetrate through virtually the entire thickness of the layer 304, facilitating substantially complete ablation.

The ability to straightforwardly vary absorber concentration is demonstrated in the following three different formulations for layer 304:

| Component (parts by weight) | Example 7 | Example 8 | Example 9 |
|---|---|---|---|
| AIRVOL 125 | 8.5 | 8.5 | 8.5 |
| Water | 167.5 | 147.5 | 107.5 |
| TRITON X-100 | 0.2 | 0.2 | 0.2 |
| BONJET CW-1 | 20.0 | 40.0 | 80.0 |
| BACOTE 20 | 14.0 | 14.0 | 14.0 |

A similar effect can be obtained by modulating the laser power, the duration of the laser pulse, or the thickness of the layer 304, or by disposing a metal (or other thermally conductive) layer beneath layer 304. For a laser outputting at a given power level, shorter pulses correspond to smaller amounts of total delivered energy. These will penetrate a layer having a particular absorber concentration to a lesser degree than will the higher energy delivered by a longer pulse. Conversely, for a fixed pulse width, total delivered energy is a function of laser power. A thermally conductive layer will draw off energy imparted to layer 304, particularly from the bottom region thereof, so once again damage, if any, from laser pulses will be confined to the top portion of the layer.

The effect of various combinations of these parameters is illustrated in the following examples.

EXAMPLE 10

A relatively thick (5 $\mu$m) layer 304 containing a high carbon-black concentration (as in Example 9) is imaged using a laser having an output of 650 mW and a pulse width of 4 $\mu$sec, and focused to a spot size of 28 $\mu$m (resulting in a fluence of ~400 mJ/cm$^2$). It is found that the laser pulse energy is absorbed in the upper (~first $\mu$m) portion of the thickness of layer 304, and so does not directly heat the remaining thickness of this layer. The "unheated" lower thickness of layer 304 provides effective thermal insulation against substrate 302, so that imaging will not be affected by substrate choice. (In fact, the lower ~4 $\mu$m will be subject to heat flow from the upper region of active absorption, but this heating will be substantially less intense, limiting the potential for thermal damage.)

Rapid heating of the upper portion of layer 304 causes ablation of this part of the layer, forming a gas pocket at the interface between layer 304 and the adjacent layer 306 or 308 that will assist interfacial detachment. The lower portion of layer 304 will remain substantially intact following imaging and will serve as a durable printing layer.

It should be emphasized that the exemplary imaging parameters set forth above are highly interrelated and can be mutually varied so as to maintain the same fluence level (e.g., by reducing the spot size, a shorter pulse width can be utilized), or individually manipulated to increase or reduce the fluence level. These variations are straightforwardly selected by those of skill in the art without undue experimentation.

EXAMPLE 11

A relatively thin (1 $\mu$m) layer 304 containing a high carbon-black concentration (as in Example 9) applied over a film substrate (or a metal substrate with an intervening polymeric layer to insulate against heat dissipation) is imaged using the same laser configuration. In this case, the laser pulse ablates most or all of the layer 304 in the manner characteristic of the prior art.

EXAMPLE 12

A relatively thick (5 $\mu$m) layer 304 containing a low carbon-black concentration (as in Example 7) is imaged using the same laser configuration. The same laser pulse energy propagates through essentially the entire thickness of layer 304, resulting in much slower heating. As a result, at the 4 $\mu$sec pulse width utilized for imaging, ablation is suppressed but layer 304 may be thermally detached from the overlying layer in accordance with the present invention.

EXAMPLE 13

A relatively thin (1 $\mu$m) layer 304 containing a low carbon-black concentration (as in Example 7) is imaged using the same laser configuration. In this case the overlying and underlying layers—even if polymeric—will act as heat sinks to dissipate the weakly absorbed laser energy. Assuming uniform absorption through the thickness of the layer 304, half the thickness of layer 304 is the long path to an adjacent heat sink, and this short distance ensures the absence of excessive heating anywhere through the layer thickness. Ablation is not observed using the noted laser configuration, but once again, irreversible detachment of layer 304 and the adjacent overlying layer is facilitated.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having first, second, and third layers, wherein (i) the first layer is oleophilic and does not significantly absorb imaging radiation, and (ii) the second layer is hydrophilic and comprises a material that absorbs imaging radiation;

b. selectively exposing the printing member to laser radiation in an imagewise pattern, laser energy being absorbed by the second layer where so exposed so as to heat the second layer and thereby irreversibly detach it from the first layer without substantial ablation of the second layer; and c. removing remnants of the first layer where the printing member received radiation, thereby creating an imagewise lithographic pattern on the printing member.

2. The method of claim 1 wherein the third layer is metal, excess energy being dissipated from the second layer at least into the third layer to prevent ablation of the second layer.

3. The method of claim 2 wherein the metal has a hydrophilic surface.

4. The method of claim 1 wherein the third layer is a polymer.

5. The method of claim 1 wherein the second and third layers are hydrophilic.

6. The method of claim 1 wherein the first layer is a nitrocellulose chemical species.

7. The method of claim 1 wherein the first layer is a polycyanoacrylate chemical species.

8. The method of claim 1 wherein the first layer is an epoxy species.

9. The method of claim 1 wherein the printing member further comprises an intermediate layer between the first and second layers, the intermediate layer being soluble in a cleaning solution.

10. The method of claim 9 wherein the intermediate layer is formed of a material selected from the group consisting of cellulosic polymers, polycyanocrylates, polyurethanes, vinyl polymers.

11. The method of claim 10 wherein the material is polyvinyl alcohol.

12. The method of claim 10 wherein the material is nitrocellulose.

13. The method of claim 10 wherein the material is polyvinyl acetate.

14. A lithographic imaging member comprising:

a. a first layer that is oleophilic and does not significantly absorb imaging radiation;

b. a second layer beneath the second layer, the second layer being hydrophilic and comprising a material that absorbs imaging radiation, exposure to imaging radiation causing the first and second layers to irreversibly detach from each other without substantial ablation, thereby facilitating removal of the first layer where detachment has taken place;

wherein c. the first layer comprises a silicone-based block copolymer having attachment blocks bonding with the second layer and intervening blocks conferring oleophilicity.

15. The member of claim 14 wherein the intervening blocks comprise mixed polymers including methylhydrogensiloxane and diorganosiloxane moieties.

16. A lithographic imaging member comprising:

a. a first layer that is oleophilic and does not significantly absorb imaging radiation;

b. a second layer thereunder that is compatible with a cleaning liquid and does not significantly absorb imaging radiation;

c. a third layer beneath the second layer, the third layer being hydrophilic and comprising a material that absorbs imaging radiation, exposure to imaging radiation causing the second and third layers to irreversibly detach without substantial ablation, thereby facilitating removal, by subjection to the cleaning liquid, of the first and second layers where detachment has taken place.

17. The member of claim 16 further comprising a substrate beneath the third layer.

18. A method of imaging a lithographic printing member, the method comprising the steps of:

a. providing a printing member having first, second, and third layers, wherein (i) the first layer is oleophilic and does not significantly absorb imaging radiation, and (ii) the second layer is hydrophilic and comprises a material that absorbs imaging radiation;

b. selectively exposing the printing member to laser radiation in an imagewise pattern, laser energy being absorbed by the second layer where so exposed so as to heat the second layer and thereby irreversibly detach it from the first layer; and c. removing remnants of the first layer where the printing member received radiation, thereby creating an imagewise lithographic pattern on the printing member, wherein the second layer is a polyvinyl alcohol chemical species.

19. A method of imaging a lithographic printing member, the method comprising the steps of:

a. providing a printing member having first, second, and third layers, wherein (i) the first layer is oleophilic and does not significantly absorb imaging radiation, and (ii) the second layer is hydrophilic and comprises a material that absorbs imaging radiation;

b. selectively exposing the printing member to laser radiation in an imagewise pattern, laser energy being absorbed by the second layer where so exposed so as to heat the second layer and thereby irreversibly detach it from the first layer; and c. removing remnants of the first layer where the printing member received radiation, thereby creating an imagewise lithographic pattern on the printing member, wherein the second layer is a cellulosic chemical species.

20. A method of imaging a lithographic printing member, the method comprising the steps of:

a. providing a printing member having first, second, and third layers, wherein (i) the first layer is oleophilic and does not significantly absorb imaging radiation, and (ii) the second layer is hydrophilic and comprises a material that absorbs imaging radiation;

b. selectively exposing the printing member to laser radiation in an imagewise pattern, laser energy being absorbed by the second layer where so exposed so as to heat the second layer and thereby irreversibly detach it from the first layer; and c. removing remnants of the first layer where the printing member received radiation, thereby creating an imagewise lithographic pattern on the printing member, wherein the first layer is a silicone chemical species.

21. The method of claim 20 wherein the second layer comprises hydroxyl groups on a surface thereof, the first layer being prepared by reacting an oleophilic silicone species with the surface hydroxyl groups of the second layer.

22. The method of claim 21 wherein the silicone species comprises hydrosiloxane functional groups that react with the surface hydroxyl groups.

23. A method of imaging a lithographic printing member, the method comprising the steps of:

a. providing a printing member having first, second, and third layers, wherein (i) the first layer is oleophilic and does not significantly absorb imaging radiation, and (ii) the second layer is hydrophilic and comprises a material that absorbs imaging radiation;

b. selectively exposing the printing member to laser radiation in an imagewise pattern, laser energy being absorbed by the second layer where so exposed so as to heat the second layer and thereby irreversibly detach it from the first layer; and c. removing remnants of the first layer where the printing member received radiation, thereby creating an imagewise lithographic pattern on the printing member, wherein the first layer is derived from a silicon hydride.

* * * * *